US009502195B2

(12) United States Patent
Freundt

(10) Patent No.: US 9,502,195 B2
(45) Date of Patent: Nov. 22, 2016

(54) SWITCHING DEVICE

(71) Applicant: SIEMENS AKTIENGESELLSCHAFT, Munich (DE)

(72) Inventor: Karsten Freundt, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/647,929

(22) PCT Filed: Nov. 21, 2013

(86) PCT No.: PCT/EP2013/074356
§ 371 (c)(1),
(2) Date: May 28, 2015

(87) PCT Pub. No.: WO2014/086587
PCT Pub. Date: Jun. 12, 2014

(65) Prior Publication Data

US 2015/0318129 A1 Nov. 5, 2015

(30) Foreign Application Priority Data

Dec. 5, 2012 (DE) ..... 10 2012 222 328

(51) Int. Cl.
*H01H 9/44* (2006.01)
*H01H 33/18* (2006.01)
*H01H 33/664* (2006.01)
*H01H 9/36* (2006.01)

(52) U.S. Cl.
CPC ..... *H01H 33/18* (2013.01); *H01H 9/44* (2013.01); *H01H 33/6641* (2013.01); *H01H 2009/365* (2013.01)

(58) Field of Classification Search
CPC ..... H01H 9/443; H01H 33/596; H01H 50/54
See application file for complete search history.

(56) References Cited

U.S. PATENT DOCUMENTS 4,021,628 A 5/1977 Kimblin
4,560,848 A * 12/1985 Arimoto ..... H01H 33/182 218/23
4,743,720 A 5/1988 Takeuchi et al.
5,138,122 A * 8/1992 Moldovan ..... H01H 9/34 218/22
5,420,555 A * 5/1995 Toguchi ..... H01H 13/063 200/243

(Continued)

FOREIGN PATENT DOCUMENTS

CN 101887823 A 11/2010
CN 102737914 A 10/2012

(Continued)

*Primary Examiner* — Truc Nguyen
(74) *Attorney, Agent, or Firm* — Laurence Greenberg; Werner Stemer; Ralph Locher

(57) ABSTRACT

A switching device includes a contact system having a movable contact to be moved along a movement direction, a stationary contact and an improved arc quenching device with a configuration for generating a magnetic field formed in a plane perpendicular to the movement direction and an electrode configuration having a first electrode conductively connected to the movable contact and a second electrode conductively connected to the stationary contact. The first electrode and the second electrode are disposed in such a way that an electric field can be generated between the first electrode and the second electrode perpendicularly to the direction of movement and perpendicularly to the magnetic field.

6 Claims, 2 Drawing Sheets

(56) References Cited

U.S. PATENT DOCUMENTS

| | | | | |
|---|---|---|---|---|
| 5,680,084 | A * | 10/1997 | Kishi | H01H 1/66 335/151 |
| 5,877,466 | A | 3/1999 | Bolongeat-Mobleu et al. | |
| 8,390,410 | B2 | 3/2013 | Kojima et al. | |
| 8,395,463 | B2 * | 3/2013 | Ito | H01H 9/34 335/202 |
| 8,816,801 | B2 * | 8/2014 | Tachikawa | H01H 1/54 335/131 |
| 8,866,034 | B2 * | 10/2014 | Fasano | H01H 9/443 218/149 |
| 2012/0261382 | A1 * | 10/2012 | Fasano | H01H 9/446 218/23 |

FOREIGN PATENT DOCUMENTS

| | | | |
|---|---|---|---|
| DE | 2600683 | A1 | 7/1976 |
| DE | 19714655 | A1 | 10/1998 |
| DE | 69728709 | T2 | 4/2005 |
| EP | 0231600 | A1 | 8/1987 |
| EP | 1760744 | A1 | 3/2007 |
| JP | S6178016 | A | 4/1986 |

* cited by examiner

SWITCHING DEVICE

BACKGROUND OF THE INVENTION

Field of the Invention

The invention relates to a switching device having a contact system comprising a movable contact and a stationary contact and an arc quenching device.

Switching devices having a contact system comprising a movable contact and a stationary contact and an arc quenching device are known from the general prior art, for example in the area of low voltage as switches with a stationary contact and a rotatably mounted movable contact, wherein an arc quenching device in the form of arc splitters is provided. In the area of medium voltage, switching devices are known, for example, as vacuum interrupters, which have a movable contact which is led out of a vacuum-tight housing in a vacuum-tight and movable fashion and a stationary contact which is likewise led out of the vacuum-tight housing in a vacuum-tight fashion, which contacts form a contact system within the vacuum-tight housing, wherein the arc quenching device is formed by slots in the contacts of the contact system, which slots are provided to generate a magnetic field and lead to widening or rotation of an electrical arc, which is quenched in the event of a zero crossing of the current.

BRIEF SUMMARY OF THE INVENTION

The problem addressed by the present invention is to design a switching device which has better arc quenching properties.

This problem is solved according to the invention by a switching device having a contact system comprising a movable contact, which can move along a movement direction, and a stationary contact, and an arc quenching device with an arrangement for generating a magnetic field formed in a plane perpendicular to the movement direction and an electrode arrangement comprising a first electrode, which is conductively connected to the movable contact, and a second electrode, which is conductively connected to the stationary contact, wherein the first electrode and the second electrode are arranged such that an electric field is formable between the first electrode and the second electrode perpendicular to the movement direction and perpendicular to the magnetic field.

A switching device such as this has improved arc quenching properties because, owing to the arrangement for generating a magnetic field and the electrode arrangement, an arc occurring in the event of a short-circuit current when the contact system is separated, which arc has electrically conductive particles as plasma, and since the magnetic field formed in the arrangement for generating the magnetic field an electric field is generatable in the electrode arrangement comprising first and second electrode, because the charged electrically conductive particles of the plasma of the arc move to the electrodes, because of the movement in the magnetic field, and create an electric field there, which causes the generation of a countercurrent, which is formed counter to the externally applied voltage and thus counteracts the arc voltage and causes or supports the arc quenching. What is particularly advantageous in the case of a switching device such as this is that it can be used both for DC-voltage operation and AC-voltage operation because the electric field formed by the magnetic-field generating arrangement and the electrode arrangement is sufficient to quench arcs during DC-voltage operation and the same effect during a half-cycle of the alternating current is likewise sufficient during AC-voltage operation to counteract the arc voltage and to support the arc quenching. The principle on which the invention is based here is that of a magnetohydrodynamic generator which is known in and of itself and in the case of which the movement of a current of conductive particles in a magnetic field caused by the force of the magnetic field on the conductive particles generates an electric field at an electrode arrangement and leads to direct current flow. Said electric field generated in the electrode arrangement is, in the case of the switching device according to the invention, advantageously of the voltage present externally and hence oriented counter to the arc voltage and hence advantageously causes or supports arc quenching.

In an advantageous configuration of the invention, the arrangement for generating the magnetic field has a U-shaped iron core the base of which is arranged between the stationary contact and an electrical connection line, which forms a current loop, of the stationary contact and the two limbs of which extend along the contact system around said core.

In other words, a type of slot motor is formed by the U-shaped iron core in the arrangement according to the advantageous configuration, in the case of which slot motor a magnetic field is generated when a sufficiently high current occurs between the limbs of the U-shaped iron core, which magnetic field exerts a force on the movable contact of the contact system, which leads to the contact system being opened. Furthermore, by means of this arrangement of the U-shaped iron core and the magnetic field generated thereby, a force is also ensured on the electrically conductive particles of the plasma current, which force can be used to form the opposing field at the electrode arrangement.

In a particularly advantageous configuration of the invention, the first electrode extends laterally from the movable contact in the direction of the stationary contact and the second electrode extends laterally from the stationary contact in the direction of the movable contact such that, when the contact system is interrupted, the first electrode and the second electrode extend along and around an intermediate space formed between the movable contact and the stationary contact. Owing to such an arrangement of first electrode and second electrode, a geometrically simple design is realized, with which the formation of the electric field between the first electrode and the second electrode perpendicular to the movement direction of the movable contact and perpendicular to the magnetic field is made possible according to the cross product of current direction and magnetic field direction.

In a particularly advantageous configuration of the invention, the movable contact is mechanically coupled to a drive in an electrically insulated manner and is conductively connected to a first electrical connection of the switching device by means of a first sliding contact. It is also possible for a flexible conductor to be used for connection instead of a sliding contact. A sliding contact or flexible conductor of this type is a simple possibility for electrically conductively connecting a first electrical connection of the switching device to the movable contact and simultaneously ensuring the movement of the movable contact for opening or closing the contact system of the switching device.

In another advantageous configuration of the invention, the first electrode is conductively connected to the first electrical connection of the switching device by means of a second sliding contact. It is also possible for a second flexible conductor to be used for connection instead of the second sliding contact. A second sliding contact or a second flexible conductor for electrically conductive connection of the first electrode to the first electrical connection of the switching device likewise enables an electrically conductive connection in a simple fashion while simultaneously ensuring the mobility of the movable contact.

The contact system and the arc quenching device can be arranged differently, for example in an air-insulated housing. In a particularly advantageous configuration of the invention, the contact system and the arc quenching device are arranged in a vacuum-tight housing, wherein a movable contact connection bolt is led out of the vacuum-tight housing in a vacuum-tight and movable fashion. The arrangement of the contact system and the arc quenching device in a vacuum-tight housing is particularly advantageous if the switching device is intended to be used in the medium-voltage range because in such a vacuum interrupter, an arc in the form of a metal-vapor plasma with extremely high conductivity occurs when the contact system is interrupted, owing to a short-circuit current. Furthermore, the short-circuit current which is intended to be interrupted is high in the medium-voltage range, with the result that a large magnetic field is generatable by the arrangement for generating the magnetic field. In the case of a simultaneously relatively low arc voltage of the arc in the vacuum interrupter, the electric field generatable between the electrode arrangement is sufficient to cause or support arc quenching.

BRIEF DESCRIPTION OF THE SEVERAL VIEWS OF THE DRAWING

The invention is explained in more detail below on the basis of the drawing and an exemplary embodiment with reference to the appended figures, in which.

DESCRIPTION OF THE INVENTION

Figure 1:
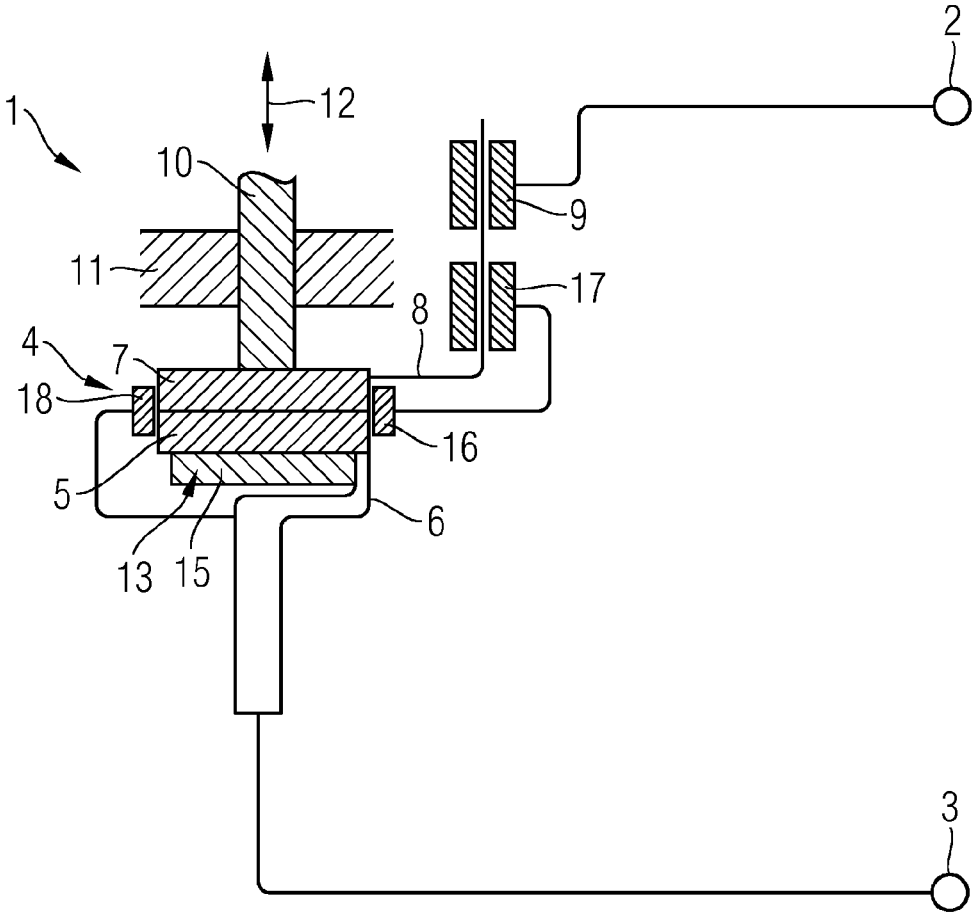
FIG. 1 shows a schematic view of an exemplary embodiment of a switching device according to the invention with closed contact system.

FIG. 1 shows a schematic view of a switching device 1 having a first electrical connection 2 and a second electrical connection 3 for connecting, for example, to a switchgear assembly in the area of power distribution. The switching device 1 is provided to interrupt the power distribution of the switchgear assembly, for example, in the event of a present short circuit which is detectable by a control unit—not illustrated in the figures—and for introducing a drive movement in a drive—likewise not illustrated in the figures—of the switching device 1, as a result of which a contact system 4 of the switching device 1 can be interrupted. The contact system 4 comprises a stationary contact 5, which is arranged in a fixed location and is conductively connected to the second electrical contact 3 via a current loop 6, and a movable contact 7, which is conductively connected to the first electrical connection 2 via an electrical line 8 and a first sliding contact 9, and by means of a drive rod 10, which is designed to be electrically insulating, to which the drive—not illustrated in the figures—of the switching device 1 is mechanically coupled. It is also possible for a flexible conductor, for example in the form of a current ribbon or the like, to be used for conductive connection instead of the sliding contact 9. A bearing 11 is provided on the drive rod 10 in order to ensure a guided movement of the drive rod and to take up any transverse forces which may arise. When a drive movement is introduced and the drive rod, which is latched in during normal operation, is unlatched, the movable contact 7 is moved in an upward direction in the exemplary embodiment in FIG. 1 or, if the short circuit has been eliminated and the contact system is to be closed again owing to a control command, moved in a downward direction, as indicated by the movement direction arrow denoted by reference sign 12. An arrangement 13 for generating a magnetic field is provided, which is formed by a U-shaped iron core 14 of which only the base 15 can be seen in FIG. 1 and is arranged between the stationary contact 5 and the current loop 6 and the limbs of which U-shaped iron core extend upward from the base around the contact system 4, as is explained in more detail below with reference to FIG. 2. The arrangement 13 for generating a magnetic field is provided here to generate a magnetic field in the event of a short-circuit current occurring, which magnetic field is formed in a plane perpendicular to the movement direction of the movable contact. A first electrode 16 is electrically conductively connected to the electrical line 8 and hence to the movable contact 7 or the first electrical connection 2 via a second sliding contact 17 and laterally extends from the movable contact 7 in the direction of the stationary contact 5. It is likewise possible for a flexible conductor, for example in the form of a current ribbon or the like, to be used for the conductive connection instead of the second sliding contact 17. A second electrode 18 is conductively connected to the current loop 6 and hence the stationary contact 5 or the second electrical connection 3 and extends laterally from the stationary contact 5 in the direction of the movable contact 7, wherein the first electrode 16 and the second electrode 18 are arranged such that they extend around the contact system 4 and the formation of an electric field between the first electrode 16 and the second electrode 18 perpendicular to the movement direction 12 of the movable contact 7 and also perpendicular to the magnetic field generated by the arrangement 13 for generating a magnetic field is made possible.

Figure 2:
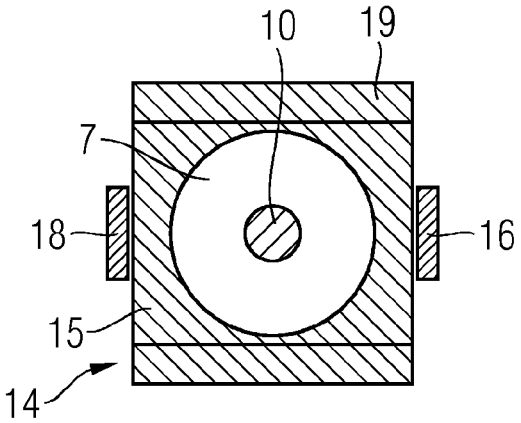
FIG. 2 shows a schematic plan view of the exemplary embodiment of the switching device according to the invention.

FIG. 2 shows a schematic plan view of the switching device 1, wherein, in FIG. 2, the movable contact 7 and the drive rod 10 can be seen along with the base 15 and a first limb 19 and a second limb 20 of the arrangement 13 for generating a magnetic field, wherein the first limb 19 and the second limb 20 extend upward from the base 15 around the contact system 4. The first electrode 16 and the second electrode 18 can likewise be seen in FIG. 2, wherein the first electrode 16 and the second electrode 18 likewise extend around the contact system 4 such that an electric field, which is formable perpendicular to the movement direction 12 of the movable contact 7 and perpendicular to the magnetic field of the arrangement 13, is generatable. In FIG. 2, the movable contact 7 is illustrated as a circular contact; however, the function of the switching device 1 with the arc quenching device is independent of the geometric shape of stationary contact 5 and movable contact 7, provided the above conditions for the electrode arrangement and the arrangement for generating the magnetic field are fulfilled.

Figure 3:
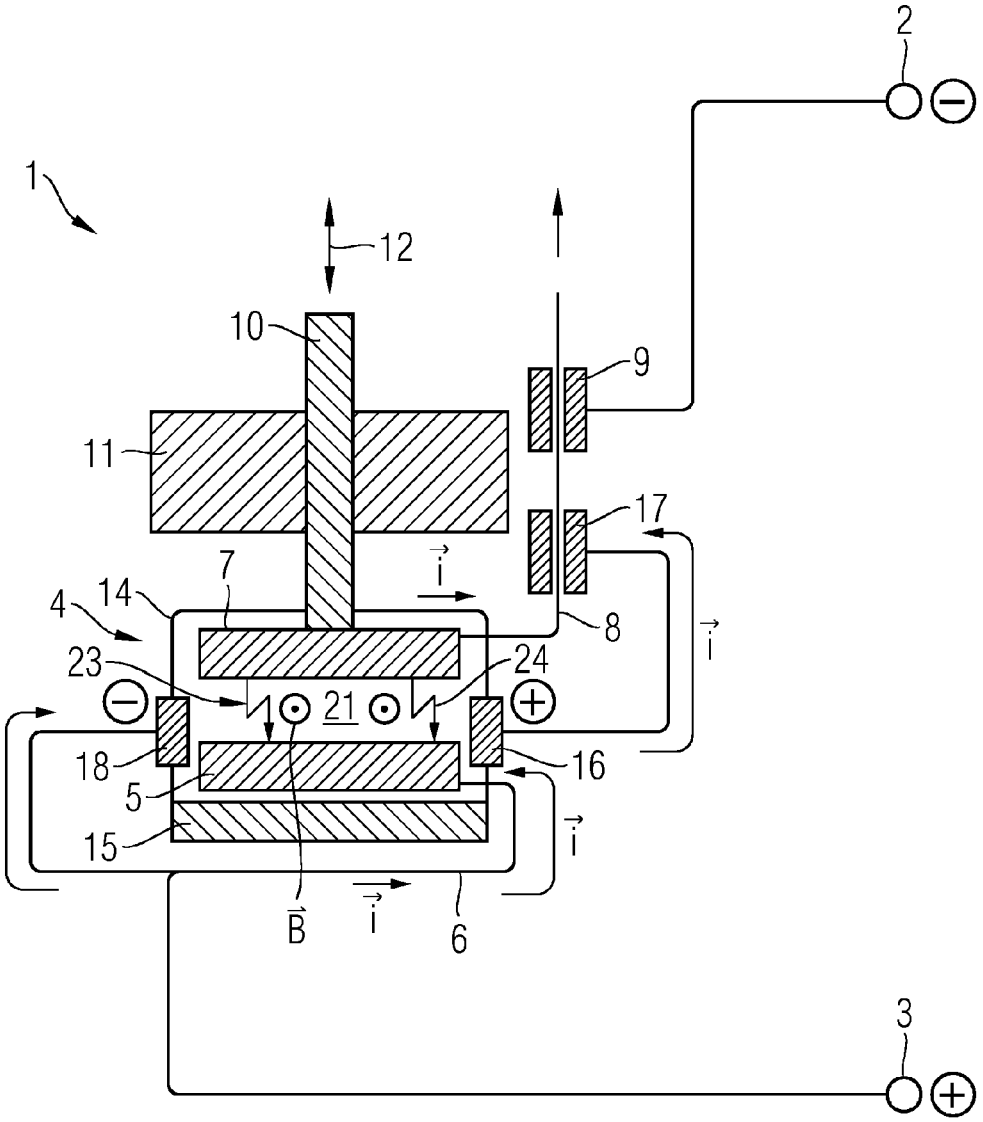
FIG. 3 shows another schematic view of the switching device according to the invention with interrupted contact system.

The function of the switching device 1 is explained in more detail with reference to FIG. 3, wherein FIG. 3 shows the switching device 1 with a contact system 4 which is already interrupted, wherein an intermediate space 21 is formed between the movable contact 7 and the stationary contact 5 since, after establishing the short-circuit current by a control device, the drive rod 10 unlatches and the drive has introduced a drive movement into the drive rod 10, wherein the opening of the contact system 4 is supported by the arrangement 13 for generating a magnetic field which, in the event of a short-circuit current, first functions like a slot motor and generates a repulsive force between movable contact and stationary contact, which force supports the opening of the contact system 4. In the case of the open contact system 4, as illustrated in FIG. 3, an arc 22 is ignited in the intermediate space 21, schematically illustrated by the jagged arrows 23 and 24, which forms a metal vapor plasma. In the exemplary embodiment of FIG. 3, the first electrical connection 2 is provided with negative polarity and the second electrical connection 3 is provided with positive polarity, this can be in accordance with an externally applied DC voltage or the polarity within a half-cycle of an externally applied AC voltage. While said polarity is present in this way, a technical current flows according to the current arrows denoted by i, wherein electrically positively charged particles thus move according to the technical current direction in the intermediate space 21 from stationary contact 5 toward movable contact 7 and, correspondingly, electrically negatively charged particles move downward from movable contact 7 to stationary contact 5. Owing to the magnetic field generated by the arrangement 13, which magnetic field extends outward in FIG. 3 from the plane of the drawing and is denoted by B, the positive charge carriers which are moving upward experience a force to the right, which moves them toward the first electrode 16, whereas the negative charge carriers experience a force to the left by the magnetic field, which moves them toward the second electrode 18, with the result that an opposing electric field occurs between the first electrode 16 and the second electrode 18, which electric field is oriented counter to the externally applied driving voltage and hence also the arc voltage and leads, in the shortest time, to the collapse or quenching of the arc in the intermediate space 21.

Although it is not illustrated further in the figures, what is particularly advantageous is the arrangement of the switching device 1 in a vacuum-tight housing, with the result that, in other words, a vacuum interrupter is formed which correspondingly accommodates the contact system 4, the arrangement 13 for generating the magnetic field and the electrode arrangement comprising first electrode 16 and second electrode 18 in a vacuum-tight housing. In the case of the conditions prevailing in the medium-voltage range, an arrangement of this type supports arc quenching in a particularly effective manner. For this purpose, both the drive rod 10 and the electrical lines 8 to the movable contact and optionally to the first electrode 16 are configured such that both the movement and the electrical connection of the movable contact 7 are introduced movably in a vacuum-tight fashion into the vacuum-tight housing of the vacuum interrupter.

LIST OF REFERENCE SIGNS

1 switching device
2 first electrical connection
3 second electrical connection
4 contact system
5 stationary contact
6 current loop
7 movable contact
8 electrical line
9 first sliding contact
10 drive rod
11 bearing
12 movement direction
13 arrangement
14 U-shaped iron core
15 base
16 first electrode
17 second sliding contact
18 second electrode
19 first limb
20 second limb
21 intermediate space
22 arc
23, 24 arc arrows

The invention claimed is:

1. A switching device, comprising:

a contact system having a movable contact being movable along a movement direction and a stationary contact;

an arc quenching device having a configuration for generating a magnetic field in a plane perpendicular to said movement direction and an electrode configuration having a first electrode being conductively connected to said movable contact and a second electrode being conductively connected to said stationary contact;

said first electrode and said second electrode being disposed for forming an electric field between said first electrode and said second electrode perpendicular to said movement direction and perpendicular to said magnetic field;

said contacts of said contact system being separated in an event of a short-circuit current and forming an arc having electrically conductive charged plasma particles;

the magnetic field generating the electric field and causing a movement of the plasma particles of the arc toward said electrodes; and the movement of the plasma particles in the magnetic field creating an electric field generating a countercurrent formed counter to an externally applied voltage and counteracting an arc voltage and causing or supporting arc quenching.

2. The switching device according to claim 1, wherein:

said stationary contact has an electrical connection line forming a current loop; and said configuration for generating said magnetic field includes a U-shaped iron core having a base disposed between said stationary contact and said electrical connection line and two limbs extending along said contact system and around said core.

3. The switching device according to claim 2, wherein:

said first electrode extends laterally from said movable contact in a direction towards said stationary contact;

said second electrode extends laterally from said stationary contact in a direction towards said movable contact; and said first electrode and said second electrode extend along and around an intermediate space formed between said movable contact and said stationary contact when said contact system is interrupted.

4. The switching device according to claim 1, which further comprises:

a first electrical connection of the switching device;

a first sliding contact or flexible conductor; and a drive;

said movable contact being mechanically coupled to said drive in an electrically insulated manner and conductively connected to said first electrical connection of the switching device by said first sliding contact or flexible conductor.

5. The switching device according to claim 4, which further comprises:

a second sliding contact or second flexible conductor;

said first electrode being conductively connected to said first electrical connection of the switching device by said second sliding contact or second flexible conductor.

6. The switching device according to claim 1, which further comprises a vacuum-tight housing in which said contact system and said arc quenching device are disposed, and a movable contact connection bolt being vacuum-tightly and movably led out of said vacuum-tight housing.

* * * * *